United States Patent [19]

Scheffel et al.

[11] Patent Number: 4,735,149

[45] Date of Patent: Apr. 5, 1988

[54] RAILWAY VEHICLE SUSPENSION

[75] Inventors: Herbert Scheffel, Pretoria; Harry M. Tournay, Verwoerdburg, both of South Africa; Klaus Riessberger, Vienna, Austria

[73] Assignee: South African Inventions Development Corporation of Administration Building, Pretoria, South Africa

[21] Appl. No.: 846,237

[22] Filed: Mar. 31, 1986

[30] Foreign Application Priority Data

Apr. 4, 1985 [ZA] South Africa ..... 85/2567
Jul. 31, 1985 [ZA] South Africa ..... 85/5778

[51] Int. Cl.[4] ..... B61F 3/08

[52] U.S. Cl. ..... 105/218.1; 105/222; 105/224.1; 105/167

[58] Field of Search ..... 105/165, 167, 182 R, 105/222, 218.1, 168, 218 A, 224.1, 197.1

[56] References Cited

U.S. PATENT DOCUMENTS

| | | | |
|---|---|---|---|
| 2,373,756 | 4/1945 | Harley et al. | 105/218 A |
| 2,800,320 | 7/1957 | Jarret et al. | 105/218 A |
| 2,901,240 | 8/1959 | Fikse | 105/197 T |
| 2,908,229 | 10/1959 | Furrer | 105/168 X |
| 3,230,899 | 1/1966 | Johnson | 105/167 X |
| 3,841,232 | 10/1974 | Hess | 105/222 X |
| 4,170,179 | 10/1979 | Vogel | 105/168 |
| 4,173,933 | 11/1979 | Kayesrling | 105/218 A X |
| 4,233,910 | 11/1980 | Schumacher | 105/168 X |
| 4,356,775 | 11/1982 | Paton et al. | 105/224.1 X |
| 4,510,871 | 4/1985 | Habeck et al. | 105/218 R X |

FOREIGN PATENT DOCUMENTS

| | | | |
|---|---|---|---|
| 837711 | 5/1952 | Fed. Rep. of Germany | 105/165 |
| 1068292 | 11/1959 | Fed. Rep. of Germany | 105/218 R |
| 3004082 | 8/1981 | Fed. Rep. of Germany | 105/182 R |
| 1585872 | 3/1981 | United Kingdom | 105/218 R |

*Primary Examiner*—David A. Scherbel
*Assistant Examiner*—Russell D. Stormer
*Attorney, Agent, or Firm*—Ladas & Parry

[57] ABSTRACT

A railway bogie or a vehicle is so suspended to axleboxes on a plurality of wheelsets that each wheelset can yaw about a center of yaw, move laterally and move vertically relatively to the frame of the bogie or vehicle. Each axle box has a pair of radially opposed arms extending vertically and links extend from the arms in opposed directions laterally to the plane containing the axis of the axle. The links are ball jointed to the arms and also at their other ends. One link is connected to the link on the other side of the frame via a mechanism transmitting motion across the frame. Such a mechanism may involve a beam pivoted to the frame, bell cranks connected by struts, a torsion bar with arms projecting from it or hydraulic conduits between links which are hydraulic piston and cylinders. The mechanism may be repeated on the other side or the links on that side may simply be jointed to the frame. The purpose of the mechanism is to inhibit longitudinal movement of the center of yaw of each wheelset.

13 Claims, 6 Drawing Sheets

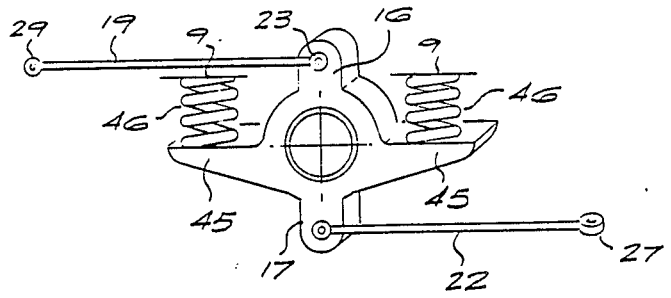
FIG. 8
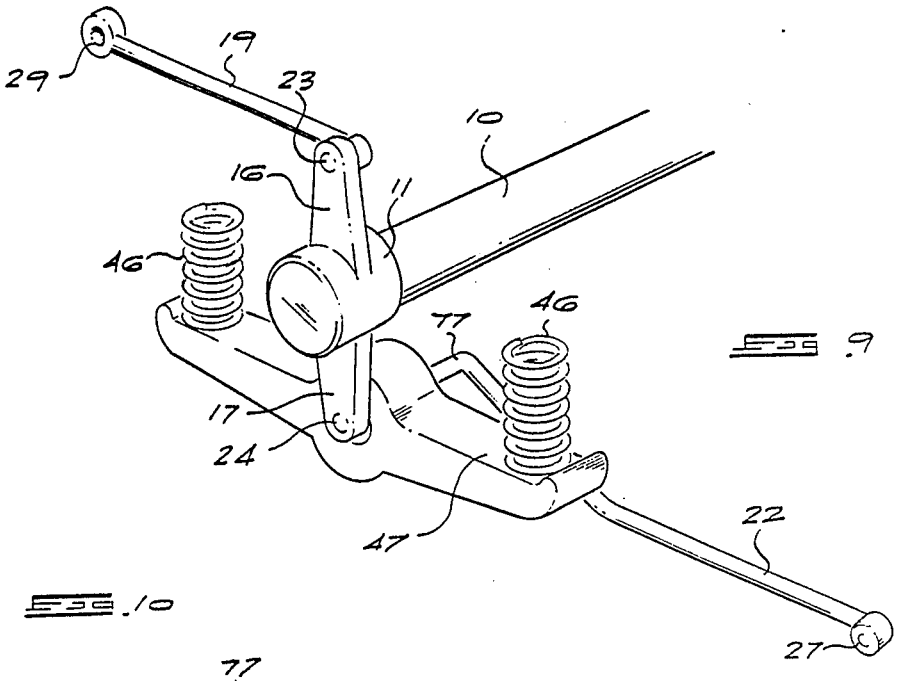
FIG. 9
FIG. 10
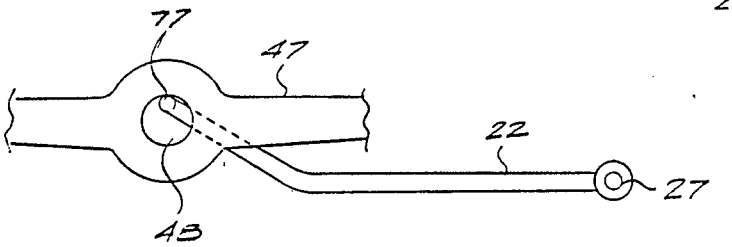

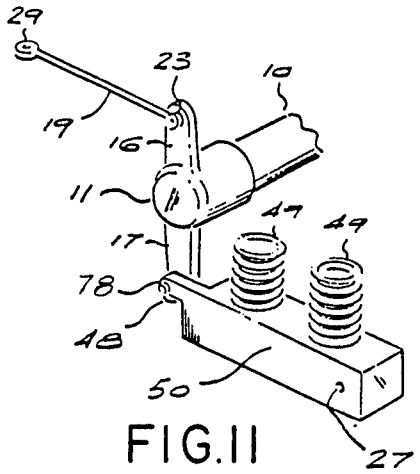
FIG.11
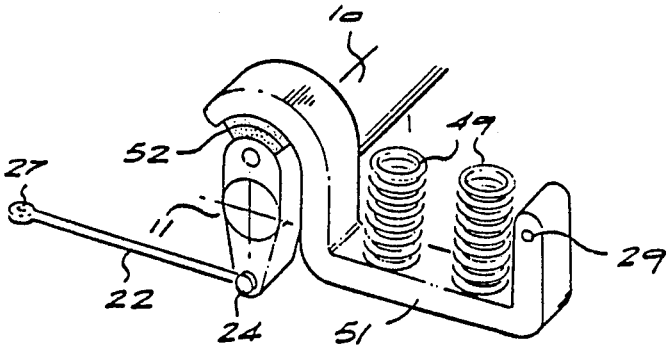
FIG.12
FIG.13
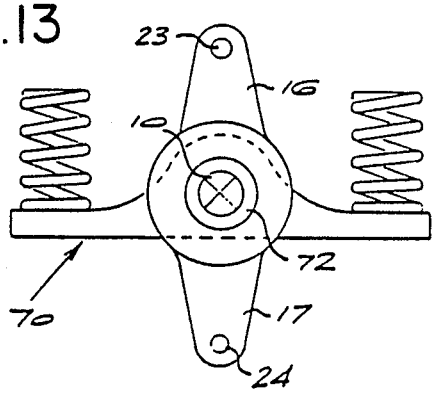

RAILWAY VEHICLE SUSPENSION

BACKGROUND TO THE INVENTION

This invention relates to railway vehicles.

For present purposes railway vehicles may be typified as being of two kinds. In the first kind the body of the vehicle is directly supported on wheelsets each of which has a pair of wheels firmly mounted on the axle. In the other kind the body is pivotally supported on bogies which in turn are directly supported on wheelsets.

In this specification and in the appended claims the term "railway truck" is defined to mean a railway unit including a frame supported on a plurality of wheelsets. Thus a railway truck may be a bogie or a vehicle, the frame being the body in the case of a vehicle and being the bogie frame in the case of a bogie.

Self-steering or radial railway trucks are known—see e.g. U.S. Pat. Nos. 4,067,261 and 4,067,262—and many such trucks are in use on the South African railway system and elsewhere in the world. Such trucks rely on wheeltreads with a high effective conicity and a spring suspension which is soft in yaw thus allowing the wheeltreads to effect self-steering.

In U.S. Pat. No. 4,067,261 the resilient elements 24 are sufficiently soft to permit the yawing motion of the wheelset relative to the truck frame or vehicle body but would deflect excessively if subjected to longitudinal forces developed between the wheelset and the truck frame. FIGS. 3 and 4 of U.S. Pat. No. 4,067,261 provide for longitudinal members 38 and 50 respectively which couple the centre of the wheelset to the truck frame. Traction forces could be transmitted through these members without restraining the axle in yaw. The two arrangments depicted by FIGS. 3 and 4 require the expense of the placing of a bearing at the centre of yaw of the wheelset, and the use of space normally occupied by traction equipment in a motorized bogie. Furthermore the longitudinal members are not suitable for taking compressive loads because, if the direction of these loads does not coincide with the longitudinal axis of the members, forces normal to this axis will tend to cause the mechanism to collapse. In addition relative vertical and lateral motion between the wheelset and the truck frame results in a change in the wheelbase causing dynamic interference.

In U.S. Pat. No. 4,480,553 it has been proposed to add along the sides of the truck a set of interconnections which, together with cross-anchors, inhibit the wheelsets from moving longitudinally relative to the truck frame. These interconnections may be oriented to permit free relative motion between the wheelsets and the truck frame in either the vertical or lateral planes. If, for example, the orientation is chosen to permit free lateral motion the interconnections will cause a change in wheelbase due to vertical motion between the wheelsets and the truck frame resulting in dynamic interference. Because of this limitation practical applications of U.S. Pat. No. 4,480,553 have been restricted to trucks having primary axlebox suspensions which are relatively stiff in the vertical plane.

U.S. Pat. No. 4,067,261 makes provision for an axlebox suspension which allows for vertical deflection at the axlebox and hence for the application of the self-steering principle to rigid frame trucks which by necessity require a primary suspension. FIG. 14 illustrates such an application but has never been utilized because of the complexity and difficulty in designing and predicting the wheelset yaw stiffness achieved in practice with such a mechanism.

It would be an advantage to provide a mechanism which has means connecting the axleboxes of the wheelsets to the truck frame in a manner which inhibits longitudinal movement of the centre of yaw of each wheelset in relation to the frame but allows vertical and lateral movement of the wheelsets relative to the frame and also allows the wheelsets to yaw thus permitting the self-steering or radial action of the wheelsets on curved track. The mechanism should permit the stiffness of the axle in yaw to be practicably obtainable under railway design conditions. Space should be available for conventional traction equipment when required.

SUMMARY OF THE INVENTION

The present invention provides a railway truck comprising:

a truck frame;

a plurality of wheelsets each consisting of two wheels firmly mounted on a common axle;

axleboxes at the ends of each wheelset to which the wheelset is journalled;

means to suspend the axleboxes to the truck frame in a manner allowing each wheelset to yaw about a centre of yaw, to move laterally and to move vertically in relation to the frame;

means extending transversely on each side of the vertical plane containing the axis of each axle and connecting each axlebox to the truck frame and on at least one side of that vertical plane also connection the two axleboxes on the same wheelset, the connecting means inhibiting longitudinal movement of the centre of yaw of each wheelset in relation to the frame.

The means to suspend the axleboxes to the truck frame may be springs in which a fairly large vertical movement may be allowed or they may be shear pads in which case only a relatively small vertical movement will be allowed.

The invention further provides that there is secured to each axlebox a pair of radially opposed arms and that the connecting means includes links which extends to the sides of the plane from the wheelset and are jointed, preferably at both ends, by means, such as ball-and-socket joints, permitting considerable angular movement in any plane.

DESCRIPTION OF THE DRAWINGS

FIG. 8 shows a spring tray arrangement suitable for use with the systems of FIGS. 1 and 4 to 8, FIGS. 9 and 10 show a spring tray arrangement also suitable for use with the systems of FIGS. 1 and 4 to 8, and FIGS. 11 to 13 show other spring tray arrangements suitable for use with the systems of FIGS. 1 and 4 to 8.

DESCRIPTION OF EMBODIMENTS

Figure 1:
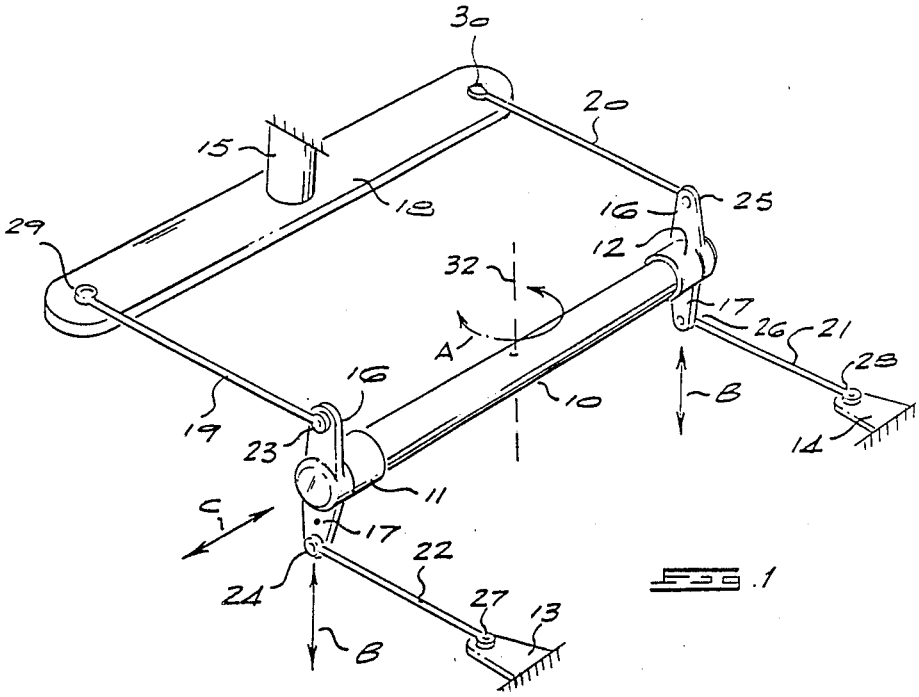
FIG. 1 is a diagrammatic perspective view of a system according to the invention.
Figure 3:
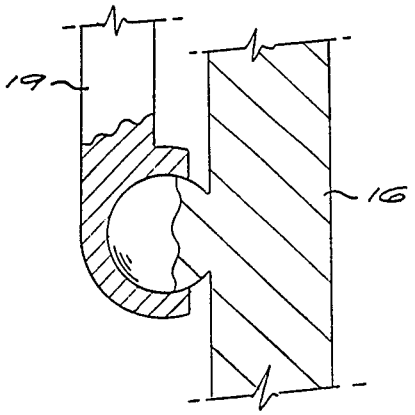
FIG. 3 is a view of a ball-and-socket joint suitable for use with the invention.
Figure 2:
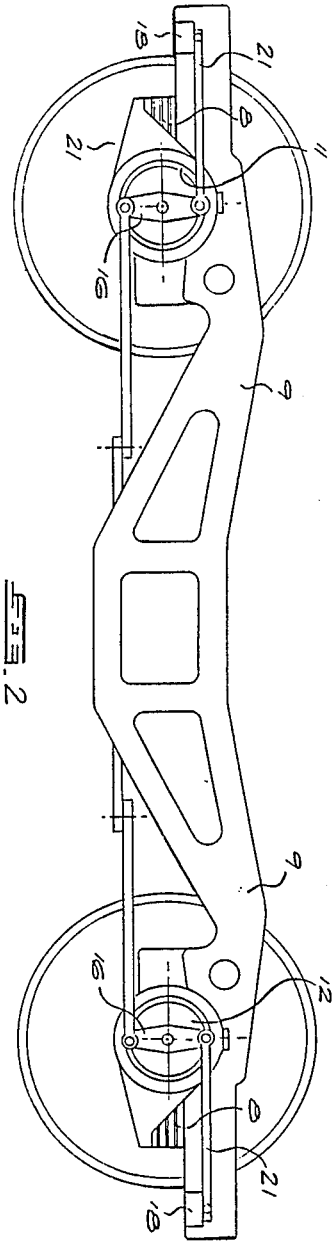
FIG. 2 is a side view of a truck embodying the system of FIG. 1.

FIGS. 1, 2 and 3 illustrate a first embodiment of the invention. FIG. 1 is rather diagrammatic and shows no wheels for the sake of clarity. The truck frame 9 has also not been illustrated in full in FIG. 1 but brackets 13 and 14 are fixed to the frame 9 as well as a pivot pin 15 as can be seen in FIG. 2. The drawings show an axle 10 with axleboxes 11 and 12. Each axle box 11 and 12 have fast with it a pair of diametrically opposed arms 16 and 17. Links 19, 20, 21 and 22 extend from ball-and-socket joints 23, 24, 25 and 26. As shown in FIG. 2 the links 19 and 20 extend towards the truck end while the links 21 and 22 extend towards the truck centre.

The links 21 and 22 are connected at their other ends to ball-and-socket joints 27 and 28 on the brackets 13 and 14. The links 19 and 20 connect with ball-and-socket joints 29 and 30 on a beam 18 which is pivoted on the pivot pin 15.

In FIG. 1 the centre of yaw of the illustrated axle 10 has been drawn as 32. In addition in FIG. 2 the frame is shown as resting on rubber spring elements 8. The elements 8 are so chosen that the axle 10 can yaw in curves about the centre 32 in the direction of the arrow A so as to be self-steering. Also the axle 10 can move up and down relatively to the frame 9 in the direction of the arrows B. Finally the axle 10 can move laterally in the direction of the arrow C.

If the axle 10 tends to move in the directions of the arrows C or B lateral or vertical movement of the axle relatively to the ball-and-socket joints 27, 28, 29 and 30 takes place, but the centre of yaw 32 remains fixed in the longitudinal direction relatively to the truck frame 9. When the element formed by the arms 16 and 17 moves relatively to the truck frame the point 16 describes an arc on the centre 29 and the point 24 describes an arc on the centre 27 and the convexities of these arcs, lying in opposite directions, compensate for each other's variation from a straight line.

Yaw of the axle 10 causes the links 19 and 20 to move in opposite senses longitudinally so that the beam 18 pivots about the pin 15. Because the joints 24 and 26 are longitudinally coupled to the truck frame 9, the axleboxes 11 and 12 are forced to pivot about the joints 24 and 26. The axle 10 can thus rotate in the direction of the arrow A about the centre 32 which remains longitudinally fixed.

The centre 32 is prevented from moving longitudinally relatively to the truck frame 9 because such a movement would require the links 19 and 20 to move in similar senses longitudinally. This is resisted by bending moments in the beam 18.

Figure 4:
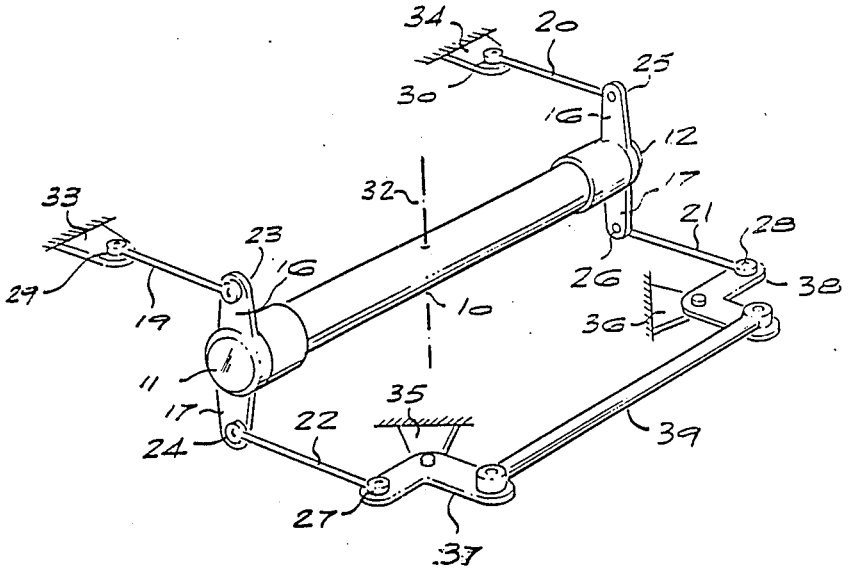
FIGS. 4 to 7 are diagrammatic perspective views of alternate systems embodying the principles of the invention.

FIG. 4 shows a system of links which can achieve the same purpose as the system in FIG. 1. In this case the links 19 and 20 are coupled to ball-and-socket joints 29 and 30 on brackets 33 fast with the truck frame 9 (not shown). The links 21 and 22 couple with ball-and-socket joints 27 and 28 on bell cranks 37 and 38. The latter pivot on brackets 35 and 36 fast with the frame. A strut 39 pivotally connects the bell cranks 37 and 38.

In this case the centre 32 is prevented from moving longitudinally in that tension and compression in the strut 39 resist pivoting of the cranks 37 and 38 in opposite senses.

Figure 5:
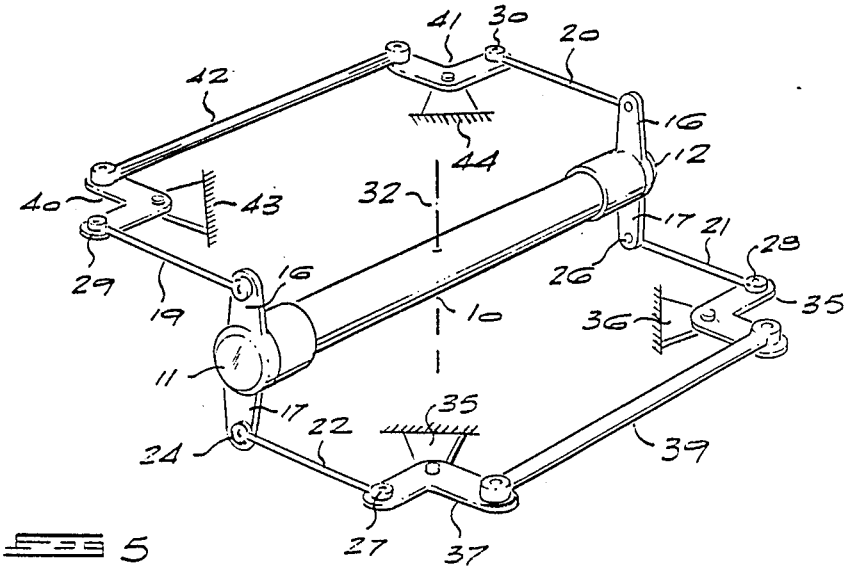

In FIG. 5 the links 19 and 20 also pivot on ball-and-socket joints on bell cranks 40 and 41 pivoted on brackets 43 and 44 on the frame.

The beam and pivot construction is equivalent to the strut and bell crank construction and both constructions could be provided to one side of each axle or to both sides as required.

Figure 6:
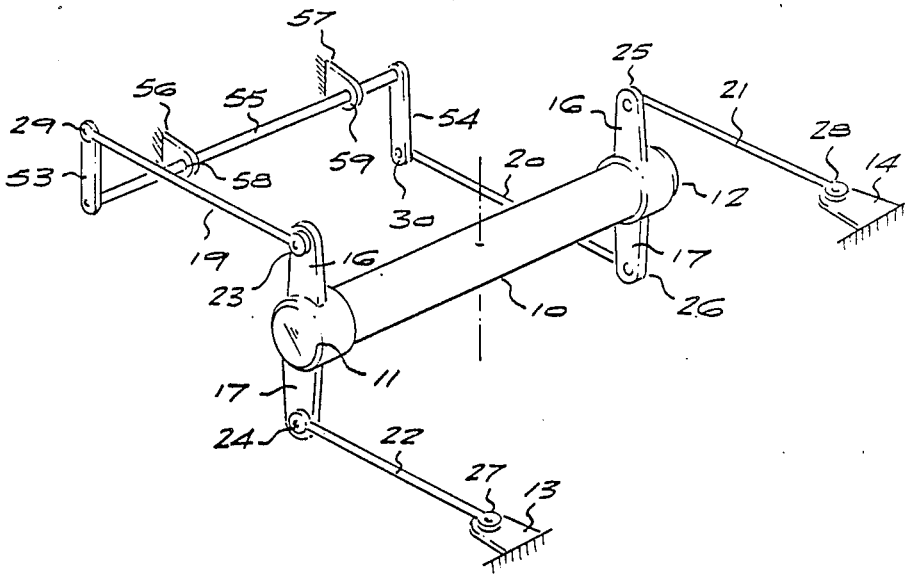

Another equivalent is illustrated in FIG. 6. Here the links 21 and 22 are connected as in FIG. 1, but to opposed ends of the arms 16, 17 as shown. The links 19 and 20 are connected to the other ends of the arms 16, 17 as shown. The links 19 and 20 are connected to the other ends of the arms 16, 17 and end on ball-and-socket joints 29 and 30 on levers 53 and 54. The latter levers project radially from the ends of a torsion bar 55 which is supported by brackets 58 and 59 on the truck frame.

In this case the centre 32 is prevented from moving longitudinally relatively to the truck frame because this motion would require the levers 53 and 54 to rotate in opposite senses. This is resisted in torsion by the bar 55.

Figure 7:
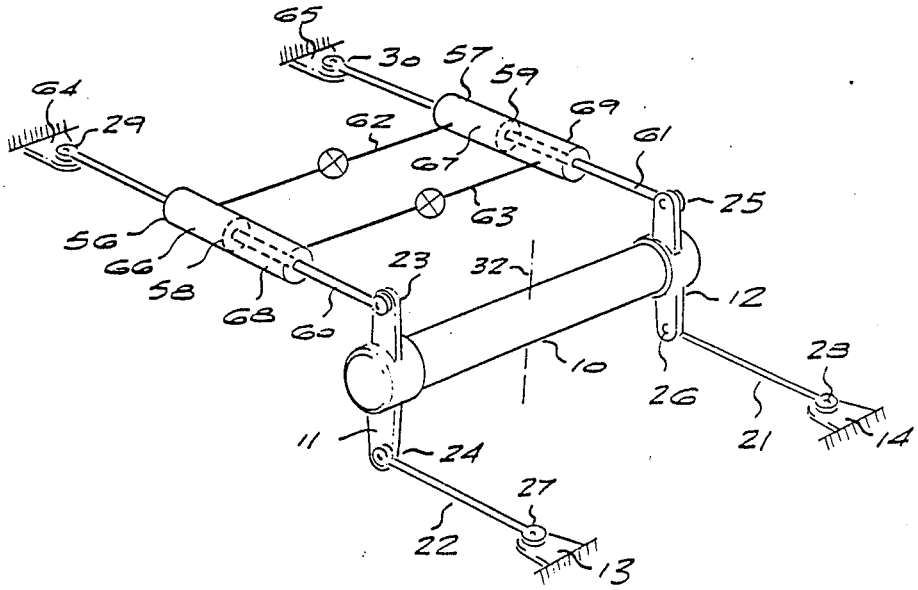

In the embodiments described up to now the links 19, 20, 21 and 22 remain of constant length. However, pairs of links on opposite sides of the frame and acting on the same axle 10 can be replaced by hydraulic piston and cylinder arrangements. In FIG. 7 the links 19 and 20 of previous embodiments have been replaced by hydraulic pistons and cylinders with pistons 58 and 59 connected by piston rods 60 and 61 to the joints 23 and 25 and cylinders 56 and 57 connected to the joints 29 and 30 which are on brackets 64 and 65 on the truck frame.

The pistons 58 and 59 divide the cylinders 56 and 57 into chambers 66, 67, 68 and 69. The chambers 66 and 67 are in hydraulic communication and so are the chambers 68 and 69 through connections 62 and 63.

On yawing of the axle 10 hydraulic fluid flows in opposite directions in the connections 62 and 63 and allows free yawing motion. However the centre 32 is prevented from moving longitudinally since this would require the pistons 58 and 69 to move axially in the same direction. This is resisted by the build up of hydraulic pressure in the relevant hydraulic chambers.

Valves or restrictive orifices may be placed in the connections 62 and 63 to provide a constriction against fluid flow and thus effect hydraulic damping to yawing. The interconnected hydraulic cylinders are thus the equivalent of the beam and pin and the bell crank and strut arrangements.

The hydraulic piston and cylinder arrangements of FIG. 7 may be added to the mechanical arrangements of FIGS. 1 and 4 to 6 or any combinations thereof. This has the advantage of incorporating hydraulic damping, while relying primarily on mechanical means to hold the centre of yaw in the longitudinal direction. The mechanical system also serves as a back-up should there be a failure in the hydraulic system.

Other damping systems may, of course, also be used with the mechanical systems.

FIG. 8 shows an axle box configuration which can be used in the embodiments of FIGS. 1 and 4 to 7. The axlebox 11 is fitted with a cruciform attachment providing the arms 16 and 17 as well as horizontally extending arms 45 serving as spring trays on which rest springs 46 on which the truck frame 9 is suspended.

In FIG. 9 a spring tray 47 is supported on an axle 77 formed by cranking the link 22. On the other side the link 21 (not shown) is similarly cranked and also carries a spring tray 47. The axle 77 passes through a hole 48 in the spring tray 47.

The pendulum action of the axlebox 11 on the axle 77 produces the yaw stiffness at the axlebox. This stiffness may be varied by varying the distances of the joints 23 and 24 from the centre line of the axle 10, the pitch of the springs 46 relatively to the centre line of the axle 10, the respective radii of the shaft 77 and the hole 48, and the stiffness and heights of the springs 46.

FIGS. 11 and 12 show spring trays which replace links, say the links 22 and 21.

In FIG. 11 the spring tray has been marked 50. It is connected to the arm 17 by means of a pin 78 in a hole 48 and to the frame by a pin 27 in a resilient bushing. The pendulum action of the pin 78 about the axis of the axle 10 provides the yaw stiffness of the wheelset. Variation in the distances of the ball joint 23 and the pin from the axis of the axle and the radii of the pin 78 and the hole 48 may be effected to get the optimum yaw stiffness.

In FIG. 12 the links 19 and 20 of FIG. 4 are replaced by spring trays 51. Ball joints 23 and 25 are replaced by spherical rubber pads 52 with torsional stiffness. Springs 49 rest on the trays 51. The height between the spherical rubber pad 52 and the axis of the shaft 10 determines the negative yaw stiffness of the wheelset. The stiffness of the pad 52 determines the positive yaw stiffness of the wheelset. By varying these two parameters a suitable yaw stiffness can be obtained.

In FIG. 13 a spring tray 70 pivots about an axle box 72. Unlike FIG. 8 the spring tray 70 remains horizontal so that the springs 73 are now deflected vertically as happens with the FIG. 9 configuration during yawing. The configuration of FIG. 13 can be applied to the systems of any of FIGS. 1, and 4 to 7 or combinations of those systems.

We claim:

1. Improvements in a self-steering railway truck of the type including a truck frame; a plurality of wheelsets each consisting of two wheels firmly mounted on a common axle; axle boxes at the ends of each wheelset to which the wheelset is journalled, and resilient means to suspend the axle boxes to the truck frame in a manner allowing each wheelset to yaw about a centre of yaw, to move laterally and to move vertically in relation to the frame and producing restoring forces to these movements; the improvement comprising means to inhibit movement of the centres of yaw, which inhibiting means comprises a pair of diametrically opposed lever arms on each axle box, link means extending transversely to each side of the vertical plane containing the axis of each axle and pivotally connecting the lever arms on each axle box to the truck frame and a linkage supported by the truck frame on one side of the vertical plane for pivotally interconnecting the transversely extending link means on opposite sides of the truck frame so that the centre of yaw of each wheelset is inhibited from moving relatively to the truck frame without interfering with yawing and lateral and vertical motion of the wheelset.

2. The truck claimed in claim 1 in which each link means is jointed at its ends by joints permitting considerable angular movement in any plane.

3. The truck claimed in claim 1 in which the linkage includes a beam extending from one side of the frame to the other side and being attached to the frame by being pivoted thereon at the centre of the beam.

4. The truck claimed in claim 1 in which the linkage comprises a pair of bell cranks each pivoted at its crank to the frame, at one end to a link means and at the other end to a strut extending between the bell cranks and across the frame.

5. The truck claimed in claim 1 in which the linkage includes a torsion bar held in brackets on the frame and having a pair of levers projecting in radially opposite directions from its ends, a second end of a link means being jointed to the end of each of the levers.

6. The truck claimed in claim 1 in which the linkage includes double acting hydraulic piston and cylinders with each end of each cylinder connected to the same end of a cylinder on the opposite end of the wheelset.

7. The truck claimed in claim 1 in which the joints permitting considerable angular movement in any plane are ball-and-socket joints.

8. The truck claimed in claim 1 in which those links which extend directly between the axleboxes and the truck frame serve as spring trays.

9. The truck claimed in claim 8 in which the joints permitting considerable angular movement in any plane are ball-and-socket joints.

10. The truck claimed in claim 8 in which the link means as spring trays are connected to the axle boxes by means of spherical rubber pads.

11. The truck claimed in claim 1 in which there are a pair of horizontally extending arms fast with each axlebox, the horizontally extending arms serving as spring trays.

12. The truck claimed in claim 1 in which a pair of arms is rotatably mounted on the end of the axle of each wheelset, the arms serving as spring trays and extending horizontally in use.

13. The truck claimed in claim 1 in which those link means extend between an axlebox and the frame are bent to provide a shaft on which a spring tray is loosely and rotatably mounted.

* * * * *